US011624991B2

(12) United States Patent
Harada

(10) Patent No.: US 11,624,991 B2
(45) Date of Patent: Apr. 11, 2023

(54) DEVELOPING DEVICE PROVIDED WITH DUCT AND IMAGE FORMING APPARATUS INCLUDING THE DEVELOPING DEVICE

(71) Applicant: KYOCERA Document Solutions Inc., Osaka (JP)

(72) Inventor: Yuzo Harada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/553,958

(22) Filed: Dec. 17, 2021

(65) Prior Publication Data

US 2022/0197186 A1 Jun. 23, 2022

(30) Foreign Application Priority Data

Dec. 23, 2020 (JP) ..... JP2020-213118

(51) Int. Cl.

*G03G 15/08* (2006.01)
*G03G 21/20* (2006.01)
*G03G 21/18* (2006.01)

(52) U.S. Cl.

CPC ..... *G03G 15/0891* (2013.01); *G03G 15/0889* (2013.01); *G03G 15/0896* (2013.01); *G03G 15/0898* (2013.01); *G03G 21/1832* (2013.01); *G03G 21/206* (2013.01); *G03G 15/0893* (2013.01)

(58) Field of Classification Search

CPC ..... G03G 15/0891; G03G 15/0889; G03G 21/206; G03G 15/0893; G03G 15/0812; G03G 15/0896; G03G 15/0942; G03G 15/0898; G03G 2221/1645; G03G 21/1832; G03G 2215/0866; G03G 2215/0872

See application file for complete search history.

(56) References Cited

U.S. PATENT DOCUMENTS 4,377,334 A * 3/1983 Nishikawa ..... G03G 15/0942 399/279
4,800,411 A * 1/1989 Tanaka ..... G06T 9/005 399/267

(Continued)

FOREIGN PATENT DOCUMENTS

JP 2016-31436 A 3/2016
KR 20080011583 A * 2/2008 ..... G03G 15/0818

*Primary Examiner* — Arlene Heredia
*Assistant Examiner* — Laura Roth
(74) *Attorney, Agent, or Firm* — Stein IP, LLC

(57) ABSTRACT

A developing device includes a developing container having a first stirring chamber and a second stirring chamber that are arranged in juxtaposition with each other and a developer carrier that carries toner in the second stirring chamber. The developing container includes a duct, an air suction port, a first filter, and a second filter. The duct is arranged adjacently to the second stirring chamber and allows air in the second stirring chamber to flow out to an exterior. The air suction port is open along a longitudinal direction of the second stirring chamber and allows communication between inside the second stirring chamber and inside the duct. The first filter covers the air suction port. The second filter is arranged on a downstream side of the first filter in an air circulation direction in the duct and covers an air circulation path in the duct.

6 Claims, 4 Drawing Sheets

(56) References Cited

U.S. PATENT DOCUMENTS

| | | | | |
|---|---|---|---|---|
| 2005/0244183 | A1* | 11/2005 | Seorl | G03G 15/11 399/93 |
| 2015/0023686 | A1* | 1/2015 | Mukataka | G03G 21/206 399/99 |
| 2016/0026119 | A1 | 1/2016 | Ohashi et al. | |
| 2018/0081299 | A1* | 3/2018 | Okuno | G03G 15/0877 |
| 2019/0302691 | A1* | 10/2019 | Kawahito | G03G 15/0875 |
| 2020/0326654 | A1* | 10/2020 | Mizutani | G03G 21/10 |

* cited by examiner

DEVELOPING DEVICE PROVIDED WITH DUCT AND IMAGE FORMING APPARATUS INCLUDING THE DEVELOPING DEVICE

INCORPORATION BY REFERENCE

This application is based upon and claims the benefit of priority from the corresponding Japanese Patent Application No. 2020-213118 filed on Dec. 23, 2020, the contents of which are incorporated herein by reference.

BACKGROUND

The present disclosure relates to a developing device and an image forming apparatus including the same.

In image forming apparatuses adopting an electrophotographic method, such as a copy machine and a printer, there has been widely used a device that causes toner to adhere to an electrostatic latent image formed on a surface of an image carrier such as a photosensitive drum so as to develop the electrostatic latent image into a toner image to be transferred later on a sheet. In such a developing device, in order to form uniform images in a continuous manner, a developer including toner contained inside a developing container is conveyed while being stirred in the developing container.

In the developing device, when a developing roller and a stirring member are rotated, air may be sucked from outside into the developing container, causing an increase in air pressure in the developing container. Such an increase in air pressure in the developing container has led to a fear that the developer might scatter from inside to outside the developing container.

For example, a conventional image forming apparatus includes a toner conveyance portion that conveys toner discharged from a developing device, a vent hole portion formed in the toner conveyance portion, an air suction portion that sucks air in the toner conveyance portion through the vent hole portion, and a filter portion that is provided at the vent hole portion and configured to trap toner. There is, therefore, no need for a dedicated collection box for trapping toner, and thus it is possible to prevent toner in the developing device from leaking to an exterior, while avoiding a size increase of the apparatus.

SUMMARY

A developing device according to one aspect of the present disclosure includes a developing container, a first stirring member and a second stirring member, and a developer carrier. The developing container includes a first stirring chamber and a second stirring chamber that are divided from each other by a partition and arranged in juxtaposition with each other and a communication portion that allows the first stirring chamber and the second stirring chamber to communicate with each other on both end sides in longitudinal directions thereof. The developing container contains a developer including toner to be supplied to an image carrier. The first stirring member and the second member are rotatably supported inside the first stirring chamber and the second stirring chamber, respectively, and convey, while stirring, the developer in mutually opposite directions along a rotational axis direction so that the developer circulates in a prescribed circulation direction. The developer carrier is rotatably supported to the developing container so as to be opposed to the image carrier, carries a part of the toner, which is contained in the second stirring chamber, and supplies the part of the toner to the image carrier. The developing container includes a duct, an air suction port, a first filter, and a second filter. The duct is arranged adjacently to the second stirring chamber and allows air in the second stirring chamber to flow out to an exterior. The air suction port is open along the longitudinal direction of the second stirring chamber and allows communication between inside the second stirring chamber and inside the duct. The first filter covers the air suction port. The second filter is arranged on a downstream side of the first filter in an air circulation direction in the duct and covers an air circulation path in the duct.

DETAILED DESCRIPTION

With reference to the appended drawings, the following describes an embodiment of the present disclosure. The present disclosure, however, is not limited to the following description.

Figure 1:
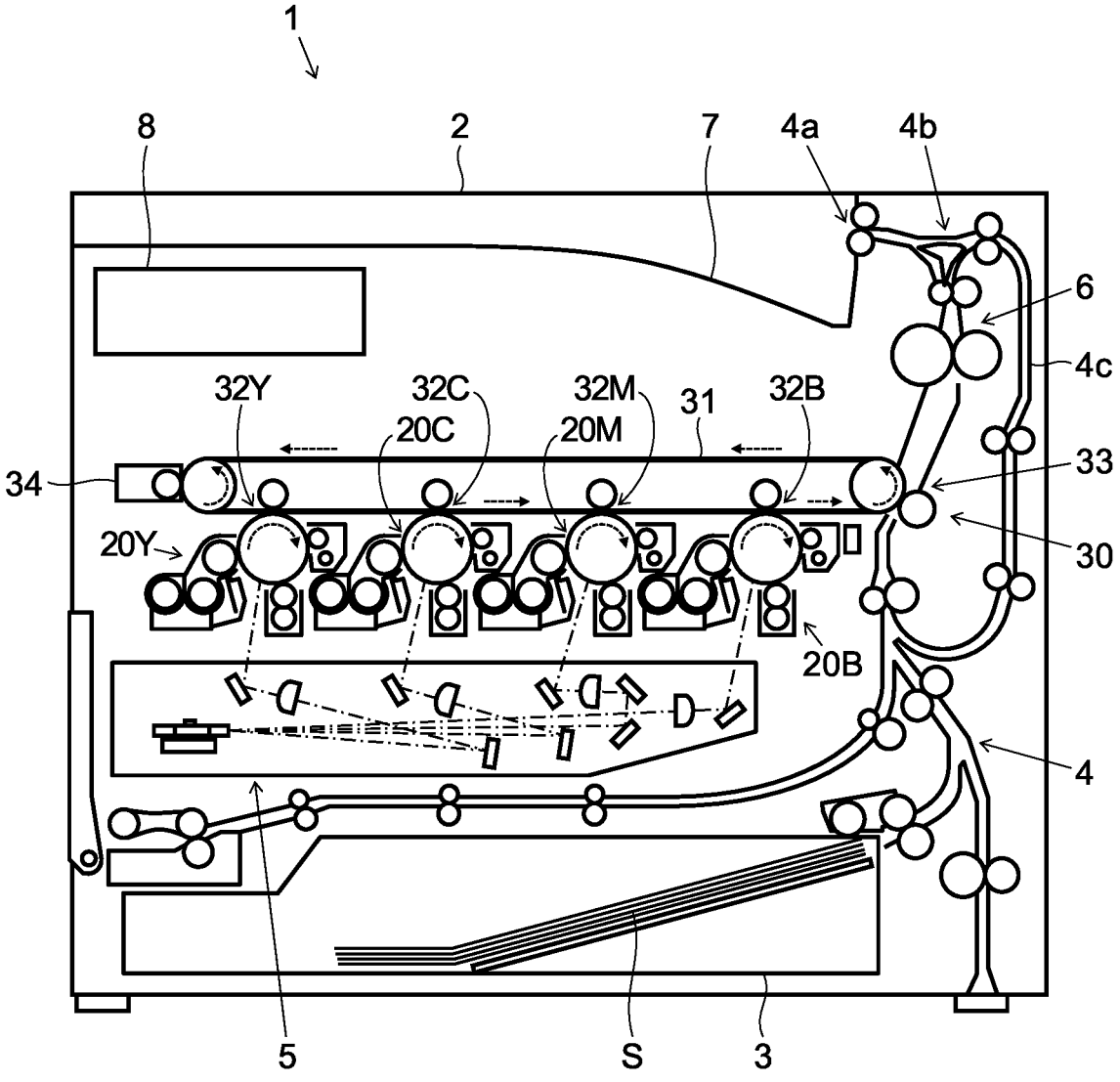
FIG. 1 is a schematic sectional front view showing a configuration of an image forming apparatus of an embodiment of the present disclosure.
Figure 2:
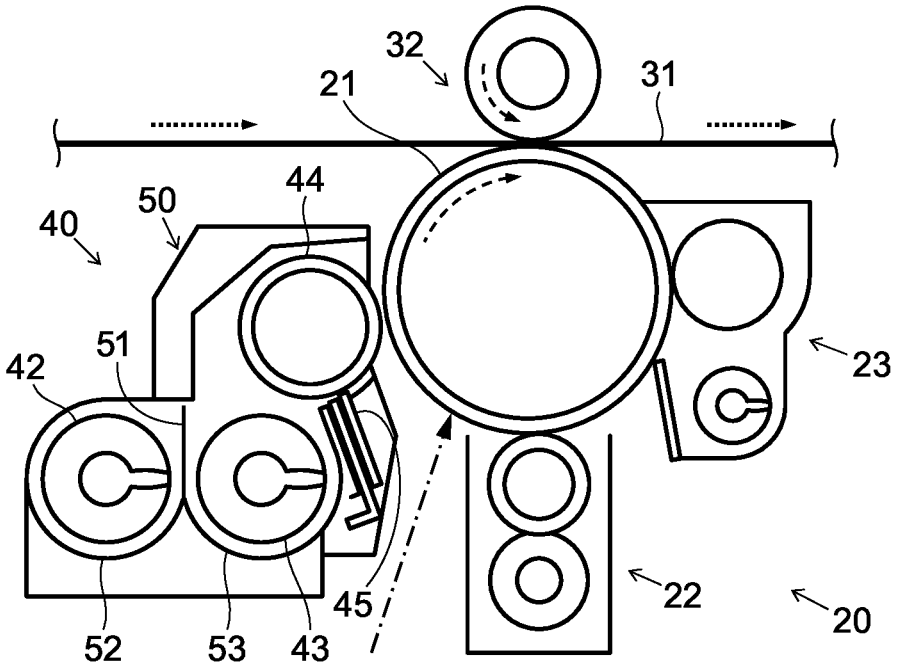
FIG. 2 is a vertical sectional front view showing a vicinity of an image forming portion of the image forming apparatus in FIG. 1.

FIG. 1 is a schematic sectional front view showing a configuration of an image forming apparatus 1 of the embodiment. FIG. 2 is a vertical sectional front view showing a vicinity of an image forming portion 20 of the image forming apparatus 1. An example of the image forming apparatus 1 of this embodiment is a tandem-type color printer that uses an intermediate transfer belt 31 to transfer a toner image to a sheet S. The image forming apparatus 1 may be a so-called multi-functional peripheral having functions of, for example, printing, scanning (image reading), and facsimile transmission.

As shown in FIG. 1 and FIG. 2, the image forming apparatus 1 includes a paper feed portion 3, a sheet conveyance portion 4, an exposure portion 5, the image forming portion 20, a transfer portion 30, a fixing portion 6, a sheet discharge portion 7, and a control portion 8, which are provided in a main body 2 of the image forming apparatus 1.

The paper feed portion 3 contains a plurality of sheets S and feeds out the sheets S one by one separately during printing. The sheet conveyance portion 4 conveys such a sheet S fed out from the paper feed portion 3 to a secondary transfer section 33 and to the fixing portion 6 and further discharges the sheet S that has been subjected to fixing to the sheet discharge portion 7 through a sheet discharge port 4*a*. In a case of performing double-sided printing, the sheet conveyance portion 4 sorts, by use of a branch portion 4*b*, the sheet S whose first side has been subjected to fixing into a reverse conveyance portion 4*c* so that the sheet S is conveyed again to the secondary transfer section 33 and to the fixing portion 6. The exposure portion 5 applies, toward the image forming portion 20, laser light controlled based on image data.

The image forming portion 20 is arranged below the intermediate transfer belt 31. The image forming portion 20 includes an image forming portion 20Y for forming a yellow image, an image forming portion 20C for forming a cyan image, an image forming portion 20M for forming a magenta image, and an image forming portion 20B for forming a black image. The four image forming portions 20 are identical in basic configuration. For this reason, in the following description, unless particularly required to be limited, identification symbols "Y," "C," "M," and "B" representing the respective colors may be omitted.

The image forming portion 20 includes a photosensitive drum (image carrier) 21 that is supported so as to be rotatable in a prescribed direction (clockwise in FIG. 1 and FIG. 2). The image forming portion 20 further includes, around the photosensitive drum 21, a charging portion 22, a developing device 40, and a drum cleaning portion 23, which are arranged along a rotation direction of the photosensitive drum 21. A primary transfer section 32 is arranged between the developing device 40 and the drum cleaning portion 23.

The photosensitive drum 21 is formed in a cylindrical shape extending in a horizontal direction and has a photosensitive layer formed on an outer circumferential surface thereof. The charging portion 22 charges the outer circumferential surface of the photosensitive drum 21 to a prescribed potential. The exposure portion 5 exposes to light the outer circumferential surface of the photosensitive drum 21 that has been charged by the charging portion 22 so that an electrostatic latent image of an original document image is formed on the outer circumferential surface of the photosensitive drum 21. The developing device 40 causes toner to adhere to the electrostatic latent image so as to develop the electrostatic latent image into a toner image. The four image forming portions 20 form toner images of the different colors, respectively. After the toner image has been primarily transferred to an outer circumferential surface of the intermediate transfer belt 31, the drum cleaning portion 23 performs cleaning to remove residual toner or the like remaining on the outer circumferential surface of the photosensitive drum 21. This is how the image forming portion 20 performs image formation on the sheet S.

The transfer portion 30 includes the intermediate transfer belt 31, primary transfer sections 32Y, 32C, 32M, and 32B, the secondary transfer section 33, and a belt cleaning portion 34. The intermediate transfer belt 31 is arranged above the four image forming portions 20. The intermediate transfer belt 31 is supported so as to be rotatable in a prescribed direction (counterclockwise in FIG. 1) and is an intermediate transfer body on which toner images formed respectively in the four image forming portions 20 are sequentially and primarily transferred in a superimposed manner. The four image forming portions 20 are arranged in so-called tandem alignment, i.e., arranged in line from an upstream side toward a downstream side in a rotation direction of the intermediate transfer belt 31.

The primary transfer sections 32Y, 32C, 32M, and 32B are arranged above the image forming portions 20Y, 20C, 20M, and 20B of the respective colors, respectively, via the intermediate transfer belt 31. The secondary transfer section 33 is arranged, in the sheet conveyance portion 4, on an upstream side of the fixing portion 6 in a sheet conveyance direction and, in the transfer portion 30, on a downstream side of the image forming portions 20Y, 20C, 20M, and 20B of the respective colors in the rotation direction of the intermediate transfer belt 31. The belt cleaning portion 34 is arranged on an upstream side of the image forming portions 20Y, 20C, 20M, and 20B of the respective colors in the rotation direction of the intermediate transfer belt 31.

In the primary transfer sections 32Y, 32C, 32M, and 32B of the respective colors, toner images are primarily transferred to the outer circumferential surface of the intermediate transfer belt 31. Further, as the intermediate transfer belt 31 rotates, at prescribed timing, toner images in the four image forming portions 20 are consecutively transferred in a superimposed manner to the intermediate transfer belt 31, and thus on the outer circumferential surface of the intermediate transfer belt 31, the toner images of the four different colors of yellow, cyan, magenta, and black are superimposed to form a color toner image.

The color toner image on the outer circumferential surface of the intermediate transfer belt 31 is transferred, at a secondary transfer nip formed in the secondary transfer section 33, to the sheet S timely conveyed thereto by the sheet conveyance portion 4. After the secondary transfer, the belt cleaning portion 34 performs cleaning to remove residual toner or the like remaining on a surface of the intermediate transfer belt 31.

The fixing portion 6 is arranged above the secondary transfer section 33. The fixing portion 6 heats and presses the sheet S on which the toner images have been transferred so as to fix the toner images to the sheet S.

The sheet discharge portion 7 is arranged above the transfer portion 30. The sheet S on which the toner images have been fixed to complete printing thereof is conveyed to the sheet discharge portion 7.

The control portion 8 includes a CPU, an image processing portion, a storage portion, and other electronic circuits and electronic components (none of these are shown). Based on control programs and data stored in the storage portion, the CPU controls operations of the various constituent elements provided in the image forming apparatus 1 so as to perform processes related to functions of the image forming apparatus 1. The paper feed portion 3, the sheet conveyance portion 4, the exposure portion 5, the image forming portion 20, the transfer portion 30, and the fixing portion 6 individually receive instructions from the control portion 8 to perform printing on the sheet S in tandem with each other. The storage portion is composed of, for example, a combination of a nonvolatile storage device such as a program ROM (read-only memory) or a data ROM and a volatile storage device such as a RAM (random-access memory).

Figure 3:
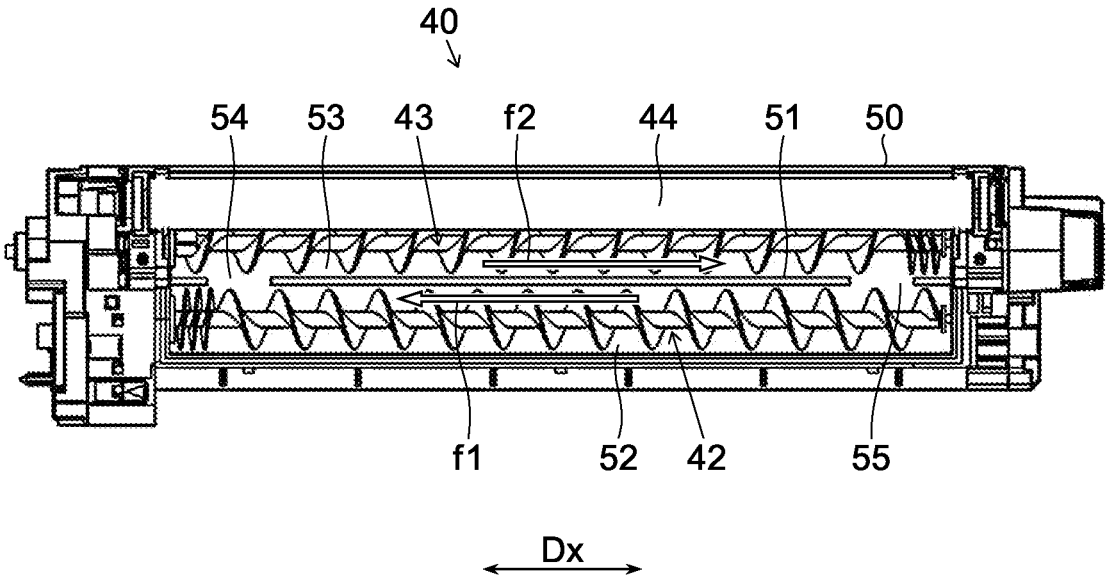
FIG. 3 is a horizontal sectional plan view of a developing device in the image forming portion in FIG. 2.
Figure 4:
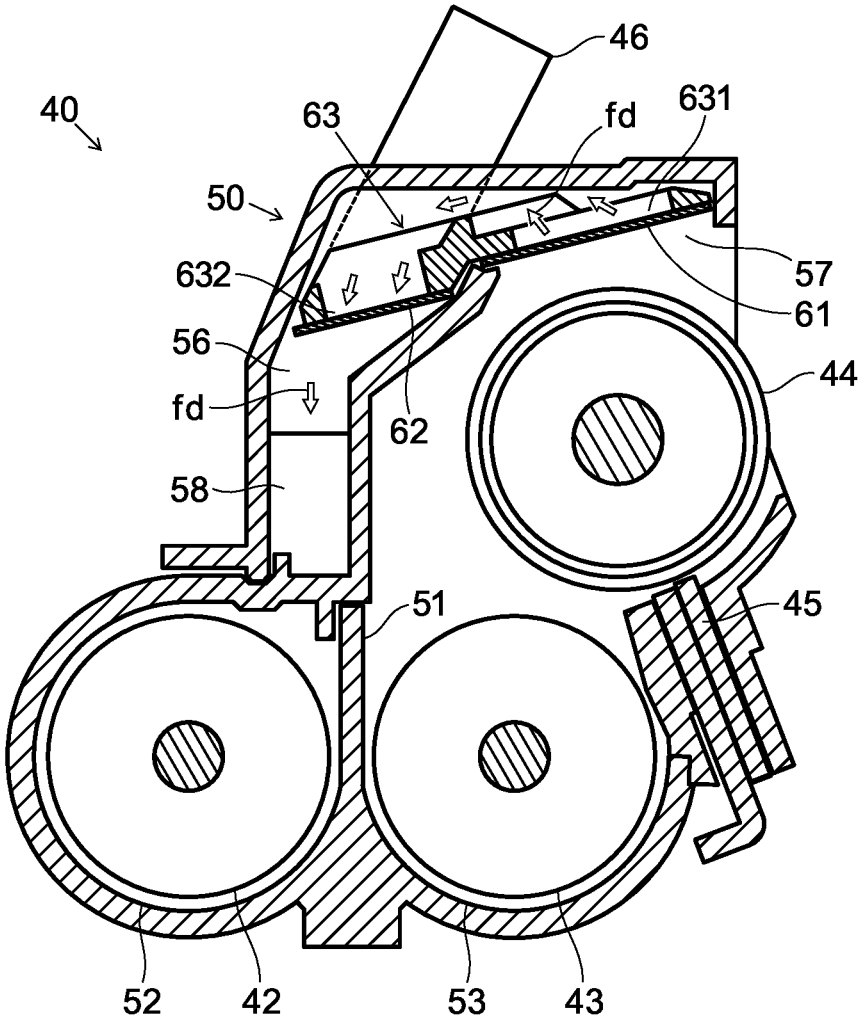
FIG. 4 is a vertical sectional front view of the developing device in the image forming portion in FIG. 2.
Figure 5:
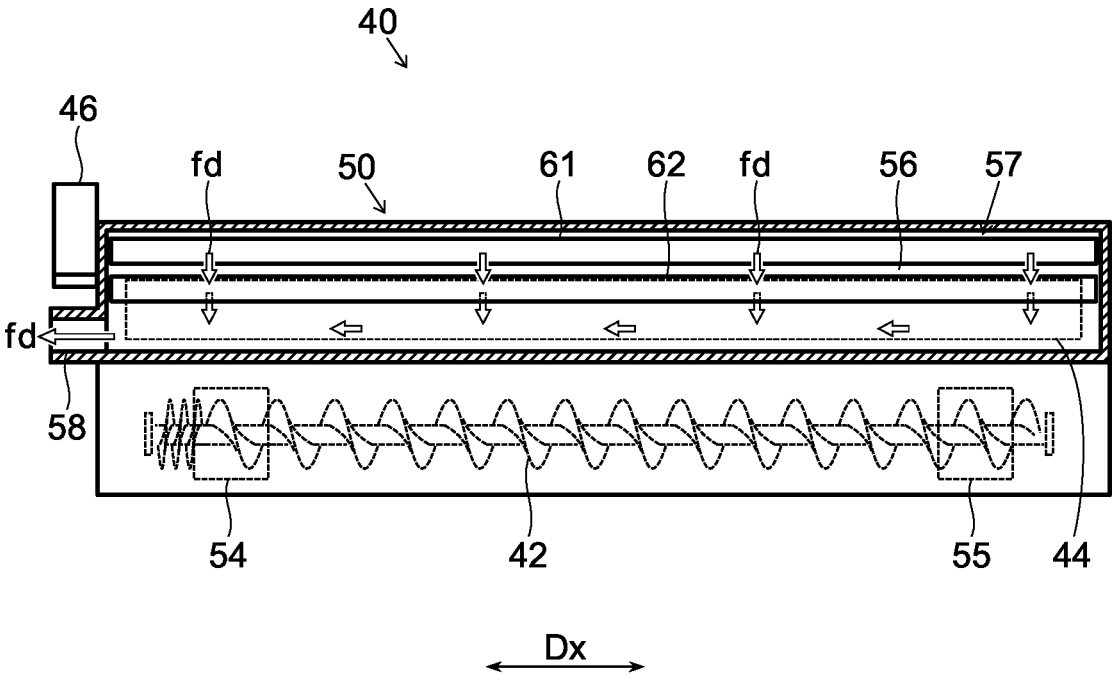
FIG. 5 is a vertical sectional side view of the developing device in the image forming portion in FIG. 2.

Next, with reference to FIG. 3, FIG. 4, and FIG. 5 in addition to FIG. 2, a description is given of a configuration of the developing device 40. FIG. 3, FIG. 4, and FIG. 5 are a horizontal sectional plan view, a vertical sectional front view, and a vertical sectional side view of the developing device 40 in the image forming portion 20 in FIG. 2, respectively. The developing devices 40 of the respective colors are identical in basic configuration, and thus, for constituent elements thereof, identification symbols representing the respective colors and descriptions thereof are omitted. Furthermore, an "axis direction" used herein refers to a rotational axis direction (a depth direction of respective planes of FIG. 2 and FIG. 4, a lateral direction in FIG. 3 and FIG. 5) of each of the photosensitive drum 21, a first stirring member 42, a second stirring member 43, and a developing roller 44, which extend parallel to each other, and is shown by an arrow Dx in the drawings.

The developing device 40 supplies toner to the outer circumferential surface of the photosensitive drum 21. The developing device 40 is mountable/demountable with respect to, for example, the main body 2 of the image forming apparatus 1.

The developing device 40 includes a developing container 50, the first stirring member 42, the second stirring member 43, the developing roller (developer carrier) 44, and a regulation member 45.

The developing container 50 has an elongated shape extending along the axis direction of the photosensitive drum 21 and is arranged such that a longitudinal direction thereof lies horizontally. That is, the longitudinal direction of the developing container 50 is parallel to the axis direction of the photosensitive drum 21. The developing container 50 contains, as a developer including toner to be supplied to the photosensitive drum 21, for example, a magnetic single-component developer including magnetic toner. As the developer, there may also be used, for example, a non-magnetic single-component developer or a two-component developer including toner and a magnetic carrier.

The developing container 50 includes a partition 51, a first stirring chamber 52, a second stirring chamber 53, a first communication portion 54, and a second communication portion 55.

The partition 51 is provided in a lower part inside the developing container 50. The partition 51 is arranged at substantially a center in a direction (a lateral direction in FIG. 2, an up-down direction in FIG. 3) intersecting with the longitudinal direction of the developing container 50. The partition 51 is formed in substantially a plate shape extending in the longitudinal direction and an up-down direction of the developing container 50. The partition 51 divides an interior of the developing container 50 in the direction intersecting with the longitudinal direction of the developing container 50.

The first stirring chamber 52 and the second stirring chamber 53 are provided inside the developing container 50. The first stirring chamber 52 and the second stirring chamber 53 are formed by dividing the interior of the developing container 50 with the partition 51. The first stirring chamber 52 and the second stirring chamber 53 are arranged in juxtaposition with each other at substantially an equal level.

In the developing container 50, the second stirring chamber 53 is arranged below an arrangement region of the developing roller 44 adjacently thereto. That is, the second stirring chamber 53 is opposed to the developing roller 44. In the developing container 50, the first stirring chamber 52 is arranged in a region more distant from the developing roller 44 than the second stirring chamber 53 is. A developer replenishment pipe (not shown) is connected to the first stirring chamber 52 so that the first stirring chamber 52 is replenished with a developer through the developer replenishment pipe. In the first stirring chamber 52, the developer is conveyed in a first direction f1 by the first stirring member 42. In the second stirring chamber 53, the developer is conveyed in a second direction f2 opposite to the first direction f1 by the second stirring member 43.

The first communication portion 54 and the second communication portion 55 are arranged respectively on outer sides of both ends of the partition 51 in a longitudinal direction thereof (corresponding to the axis direction Dx). The first communication portion 54 and the second communication portion 55 allow communication between the first stirring chamber 52 and the second stirring chamber 53 in a direction (the lateral direction in FIG. 2, the up-down direction in FIG. 3) intersecting with the longitudinal direction of the partition 51, namely, a thickness direction of the partition 51 having substantially the plate shape.

The first communication portion 54 allows communication between a downstream end of the first stirring chamber 52 in the first direction f1 and an upstream end of the second stirring chamber 53 in the second direction f2. In the first communication portion 54, a developer is conveyed in a direction from the first stirring chamber 52 toward the second stirring chamber 53. The second communication portion 55 allows communication between a downstream end of the second stirring chamber 53 in the second direction f2 and an upstream end of the first stirring chamber 52 in the first direction f1. In the second communication portion 55, the developer is conveyed in a direction from the second stirring chamber 53 toward the first stirring chamber 52.

The first stirring member 42 is arranged in the first stirring chamber 52. The second stirring member 43 is arranged in the second stirring chamber 53. The second stirring member 43 extends in proximity to and parallel to the developing roller 44. The first stirring member 42 and the second stirring member 43 are supported to the developing container 50 so as to be rotatable about an axis extending in a horizontal direction and parallel to the developing roller 44. The first stirring member 42 and the second stirring member 43 are identical in basic configuration.

The first stirring member 42 conveys, while stirring, a developer in the first direction f1 from the second communication portion 55 toward the first communication portion 54 along the rotational axis direction Dx. The second stirring member 43 conveys, while stirring, the developer in the second direction f2 from the first communication portion 54 toward the second communication portion 55 along the rotational axis direction Dx.

The developing roller (developer carrier) 44 is arranged above the second stirring member 43 in the developing container 50. The developing roller 44 is supported to the developing container 50 so as to be rotatable about an axis extending parallel to an axis of the photosensitive drum 21. The developing roller 44 includes, for example, a cylindrical developing sleeve that rotates counterclockwise in FIG. 2 and FIG. 4 and a developing-roller-side magnetic pole secured in the developing sleeve (neither of these are shown).

A part of an outer circumferential surface of the developing roller 44 is exposed from the developing container 50 and opposed in proximity to the photosensitive drum 21. In an opposing region in which the developing roller 44 is opposed to the photosensitive drum 21, the developing roller 44 carries, on the outer circumferential surface thereof, toner to be supplied to the outer circumferential surface of the photosensitive drum 21. The developing roller 44 supplies a part of the toner, which is contained in the second stirring chamber 53 of the developing container 50, to the photosensitive drum 21. In other words, the developing roller 44 causes the part of the toner in the second stirring chamber 53 to adhere to an electrostatic latent image on the outer circumferential surface of the photosensitive drum 21 so that a toner image is formed thereon.

In the opposing region in which the developing roller 44 is opposed to the photosensitive drum 21, the regulation member 45 is arranged on an upstream side in a rotation direction of the developing roller 44. The regulation member 45 is arranged so as to be opposed in proximity to the developing roller 44, with a prescribed distance provided between a distal end thereof and the outer circumferential surface of the developing roller 44. The regulation member 45 extends over an entire region of the developing roller 44 in the axis direction Dx. The regulation member 45 regulates a layer thickness of a developer (toner) carried on the outer circumferential surface of the developing roller 44 and passing through a gap between the distal end of the regulation member 45 and the outer circumferential surface of the developing roller 44.

The first stirring member 42 and the second stirring member 43 rotate to cause a developer in the developing container 50 to circulate in a prescribed circulation direction between the first stirring chamber 52 and the second stirring chamber 53 through the first communication portion 54 and the second communication portion 55. At this time, toner in the developing container 50 is stirred to be charged and thus moves to the outer circumferential surface of the developing roller 44. The toner thus carried on the outer circumferential surface of the developing roller 44 is regulated in layer thickness by the regulation member 45 and then is conveyed by rotation of the developing roller 44 to the opposing region in which the developing roller 44 is opposed to the photosensitive drum 21. When a prescribed development voltage is applied to the developing roller 44, due to a potential difference between a potential of the development voltage and a potential on the outer circumferential surface of the photosensitive drum 21, in the opposing region, the toner carried on the outer circumferential surface of the developing roller 44 moves to the outer circumferential surface of the photosensitive drum 21. Thus, an electrostatic latent image on the outer circumferential surface of the photosensitive drum 21 is developed.

Next, with reference to FIG. 4 and FIG. 5, a description is given of a more detailed configuration of the developing container 50. In FIG. 4 and FIG. 5, there is shown an arrow indicating an air circulation direction fd in a duct 56.

The developing container 50 includes the duct 56, an air suction port 57, an air exhaust port 58, a first filter 61, and a second filter 62.

The duct 56 is arranged adjacently to the second stirring chamber 53. In a direction (a lateral direction in FIG. 4, a depth direction of a plane of FIG. 5) intersecting with the longitudinal direction of the developing container 50, the duct 56 is opposed to the photosensitive drum 21 via an arrangement region of the developing roller 44 in the developing container 50. The duct 56 is connected at an upstream end thereof in the air circulation direction to the second stirring chamber 53. The duct 56 allows air in the second stirring chamber 53 to flow out to an exterior.

The air suction port 57 is arranged at a connection point between the duct 56 and the second stirring chamber 53 on an upper side of the developing roller 44. That is, the air suction port 57 is positioned at the upstream end of the duct 56 in the air circulation direction. The air suction port 57 is open along a longitudinal direction of the second stirring chamber 53. The air suction port 57 is formed in, for example, a rectangular shape extending in the longitudinal direction of the second stirring chamber 53 and is opposed to the developing roller 44. The air suction port 57 allows communication between inside the second stirring chamber 53 and inside the duct 56. Air in the second stirring chamber 53 flows into the duct 56 through the air suction port 57.

The air exhaust port 58 is arranged, for example, in a rear part of the developing container 50. The air exhaust port 58 is positioned at a downstream end of the duct 56 in the air circulation direction. Air in the second stirring chamber 53 is discharged from inside the duct 56 through the air exhaust port 58. At the air exhaust port 58, the duct 56 may be connected to another air exhaust path in the main body 2. The other air exhaust path may be provided with an air exhaust fan. With this configuration, for example, when the air exhaust fan is driven, air in the second stirring chamber 53 is forcibly discharged to the exterior through the duct 56.

The first filter 61 is arranged at a location of the air suction port 57. The first filter 61 is identical in shape to the air suction port 57 and is formed in, for example, a rectangular shape extending in the longitudinal direction of the second stirring chamber 53. The first filter 61 covers the air suction port 57. That is, the first filter 61 is opposed to the developing roller 44. The first filter 61 is made of, for example, a nonwoven fabric and traps a developer contained in air flowing into the duct 56 from the second stirring chamber 53.

In the duct 56, the second filter 62 is arranged on a downstream side of the first filter 61 in the air circulation direction. The second filter 62 is identical in shape to a cross section in the duct 56 in a direction intersecting with the air circulation direction and is formed in, for example, a rectangular shape extending in the longitudinal direction of the second stirring chamber 53. The second filter 62 covers an air circulation path in the duct 56. The second filter 62 is made of, for example, a nonwoven fabric and traps a developer contained in air circulating in the duct 56 after passing through the first filter 61.

According to the above-described configuration, the first filter 61 and the second filter 62 are provided, and the duct 56 that allows air in the second stirring chamber 53 to flow out to the exterior is provided in the developing container 50 itself. There is, therefore, no filter provided externally to the developing device 40, and thus it is possible to avoid a size increase of the image forming apparatus 1. Furthermore, when the developing device 40 is replaced with a new one upon reaching an end of its service life, the first filter 61 and the second filter 62 can also be replaced with new ones at the same time. Accordingly, it is possible to suppress scattering of a developer to an exterior of the developing container 50 by use of a configuration achieving size reduction and improved maintainability.

Preferably, the air suction port 57 is formed to extend over an entire region of the second stirring chamber 53 in the longitudinal direction thereof. According to this configuration, in the developing container 50, a large-sized opening having an increased area can be formed as the air suction port 57. That is, it is possible to efficiently trap a developer by use of the first filter 61 while achieving size reduction of the developing device 40.

The first filter 61 is formed by a production method such as, for example, a needle punching method, is made of a nonwoven fabric of a fiber having a circular cross section and a fiber diameter of 10 μm to 20 μm, and has a thickness of about 1 mm. The second filter 62 is formed by a production method such as, for example, a spun-bonding method, is made of a nonwoven fabric of a fiber having a circular cross section and a fiber diameter of 20 μm to 40 μm, and has a thickness of about 0.2 mm.

The second filter 62 has meshes finer than those of the first filter 61. That is, the second filter 62 has higher trapping efficiency than that of the first filter 61. According to this configuration, the first filter 61 can be configured not to trap a developer in the second stirring chamber 52 in bulk so as to be unlikely to be clogged. Moreover, the second filter 62 can prevent the developer from leaking to an exterior of the developing device 40.

Furthermore, the developing device 40 includes a vibration generation portion 46. For example, the vibration generation portion 46 is arranged adjacently to a back surface of the developing container 50. The vibration generation portion 46 includes, for example, a vibration motor, a control substrate, and other electronic circuits and electronic components (none of these are shown). The vibration motor has an output shaft to which a vibration weight whose gravity center position is eccentric with respect to a rotational axis of the output shaft is attached.

The vibration generation portion 46 is connected to the first filter 61 and the second filter 62. When the vibration motor is driven, the vibration generation portion 46 causes the first filter 61 and the second filter 62 to vibrate. According to this configuration, it is possible to cause toner adhering to the first filter 61 and the second filter 62 to drop by vibration. The first filter 61 is caused to vibrate, and thus it is possible to cause toner adhering to the first filter 61 to drop in the second stirring chamber 53. The second filter 62 is caused to vibrate, and thus it is possible to suppress clogging of the second filter 62.

Furthermore, the developing container 50 includes a holding member 63 shown in FIG. 4. In FIG. 5, depiction of the holding member 63 is omitted.

As shown in FIG. 4, the holding member 63 is arranged upstream in the air circulation direction in the duct 56. The holding member 63 is formed in substantially a plate shape extending along the longitudinal direction of the developing container 50. The holding member 63 includes a first holding portion 631 and a second holding portion 632. The first holding portion 631 and the second holding portion 632 have respective openings that penetrate the holding member 63 having substantially a plate shape in a thickness direction and are formed in a rectangular shape extending in the longitudinal direction of the developing container 50.

The first holding portion 631 is arranged on an upstream side of the second holding portion 632 in the air circulation direction. The first holding portion 631 is positioned at a location of the air suction port 57. The first holding portion 631 holds the first filter 61. The first filter 61 covers the rectangular opening of the first holding portion 631 and also covers the air suction port 57. The second holding portion 632 holds the second filter 62. The second filter 62 covers the rectangular opening of the second holding portion 632 and also covers the air circulation path in the duct 56. Respective toner trapping surfaces of the first filter 61 and the second filter 62 extend parallel to each other in the holding member 63.

As described above, the developing container 50 includes the single holding member 63 that holds both of the first filter 61 and the second filter 62. According to this configuration, it is possible to easily mount the first filter 61 and the second filter 62 in the developing container 50. Furthermore, it is possible to stabilize a positional relationship between the first filter 61 and the second filter 62. Furthermore, since two filters can be held by a single holding member, it is possible to reduce the number of components used.

Furthermore, the holding member 63 is connected to the vibration generation portion 46. According to this configuration, only the holding member 63 is caused to vibrate by the vibration generation portion 46, and thus it is possible to cause the first filter 61 and the second filter 62 to vibrate at the same time.

While the foregoing has described the embodiment of the present disclosure, the scope of the present disclosure is not limited thereto, and the present disclosure can be implemented by adding various modifications thereto without departing from the spirit of the disclosure.

For example, while in the foregoing embodiment, the image forming apparatus 1 is a so-called tandem-type color printing image forming apparatus that forms images of a plurality of colors by sequentially superimposing them on each other, there is no limitation to such an apparatus type. The image forming apparatus may be a non-tandem-type color printing image forming apparatus or a monochrome printing image forming apparatus.

What is claimed is:

1. A developing device, comprising:

a developing container that includes:

a first stirring chamber and a second stirring chamber that are divided from each other by a partition and arranged in juxtaposition with each other; and a communication portion that allows the first stirring chamber and the second stirring chamber to communicate with each other on both end sides in longitudinal directions thereof, the developing container containing a developer including toner to be supplied to an image carrier;

a first stirring member and a second stirring member that are rotatably supported inside the first stirring chamber and the second stirring chamber, respectively, and convey, while stirring, the developer in mutually opposite directions along a rotational axis direction so that the developer circulates in a prescribed circulation direction; and a developer carrier that is rotatably supported to the developing container so as to be opposed to the image carrier and supplies a part of the toner, which is contained in the second stirring chamber, to the image carrier, wherein the developing container includes:

a duct that is arranged adjacently to the second stirring chamber and allows air in the second stirring chamber to flow out to an exterior;

an air suction port that is arranged on an upper side of the developer carrier so as to be opposed to the developer carrier, is open along the longitudinal direction of the second stirring chamber, and allows communication between inside the second stirring chamber and inside the duct;

a first filter that covers the air suction port; and a second filter that is arranged at a position on a downstream side of the first filter in an air circulation direction in the duct, which is apart from the first filter and at which air in the duct circulates from top to bottom, and covers an air circulation path in the duct.

2. The developing device according to claim 1, wherein the air suction port is formed to extend over an entire region of the second stirring chamber in the longitudinal direction thereof.

3. The developing device according to claim 1, wherein the second filter has higher trapping efficiency than that of the first filter.

4. The developing device according to claim 1, further comprising:

a vibration generation portion that causes the first filter and the second filter to vibrate.

5. The developing device according to claim 1, further comprising:

a single holding member that holds both of the first filter and the second filter.

6. An image forming apparatus comprising the developing device according to claim 1.

* * * * *